United States Patent [19]

Barlow

[11] Patent Number: 4,928,960

[45] Date of Patent: May 29, 1990

[54] LATCH & LATCH RELEASE MECHANISM FOR A GAME

[75] Inventor: Gordon A. Barlow, Highland Park, Ill.

[73] Assignee: Gordon Barlow Design, Skokie, Ill.

[21] Appl. No.: 361,570

[22] Filed: Jun. 5, 1989

[51] Int. Cl.[5] ..... A63F 9/00

[52] U.S. Cl. ..... 273/1 GG

[58] Field of Search ..... 273/1 GG, 1 G, 129 S

[56] References Cited

U.S. PATENT DOCUMENTS

| | | | |
|---|---|---|---|
| 2,522,160 | 9/1950 | Borchers | 273/129 S X |
| 3,009,452 | 11/1961 | Barber et al. | 273/129 S X |
| 3,168,311 | 2/1965 | Sinden | 273/1 GG |
| 4,403,440 | 9/1983 | Wolff | 273/129 S X |
| 4,474,308 | 10/1984 | Bergeron | 273/129 S X |

*Primary Examiner*—Paul E. Shapiro

*Attorney, Agent, or Firm*—Kinzer, Plyer, Dorn, McEachran & Jambor

[57] ABSTRACT

A latch and latch release mechanism for an indicator which visually signals the movement of a tensioned sliding bar along a game board. The mechanism includes an indicator in the shape of a fanciful apple pivotally mounted for movement between a lowered position and an upstanding position. A rubber band urges the indicator to its upstanding position. A latch is formed on the indicator and is positioned to engage the sliding bar when the indicator is in its lowered position to retain the indicator in this position. A row of teeth is formed on the game board and aligned with the path of movement of the tensioned sliding bar. A finger is mounted on the indicator and engageable with the teeth when the indicator is in its lowered position to twist the indicator and release the latch from engagement with the sliding bar when the sliding bar moves. The finger is movable vertically between a tooth-engaging position and a tooth-clearing position to permit the indicator to be latched to the sliding bar in any position of the sliding bar.

1 Claim, 2 Drawing Sheets

LATCH & LATCH RELEASE MECHANISM FOR A GAME

BACKGROUND AND SUMMARY OF THE INVENTION

This invention is concerned with a tabletop game having a tensioned sliding bar which is prevented from movement in one direction by engagement with a matrix of interlocked playing pieces on a game board, and, particularly, with a game having an indicator on the sliding bar that indicates the slightest movement of the sliding bar when a playing piece is removed from the matrix.

An object of this invention is a latch and latch release mechanism for an indicator which permits latching of the indicator in its non-indicating position, regardless of the position of the sliding bar on the game board.

Another object of this invention is a sliding bar having a releasable locking mechanism which holds the sliding bar against movement while the playing pieces are installed on the game board.

Other objects of this invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
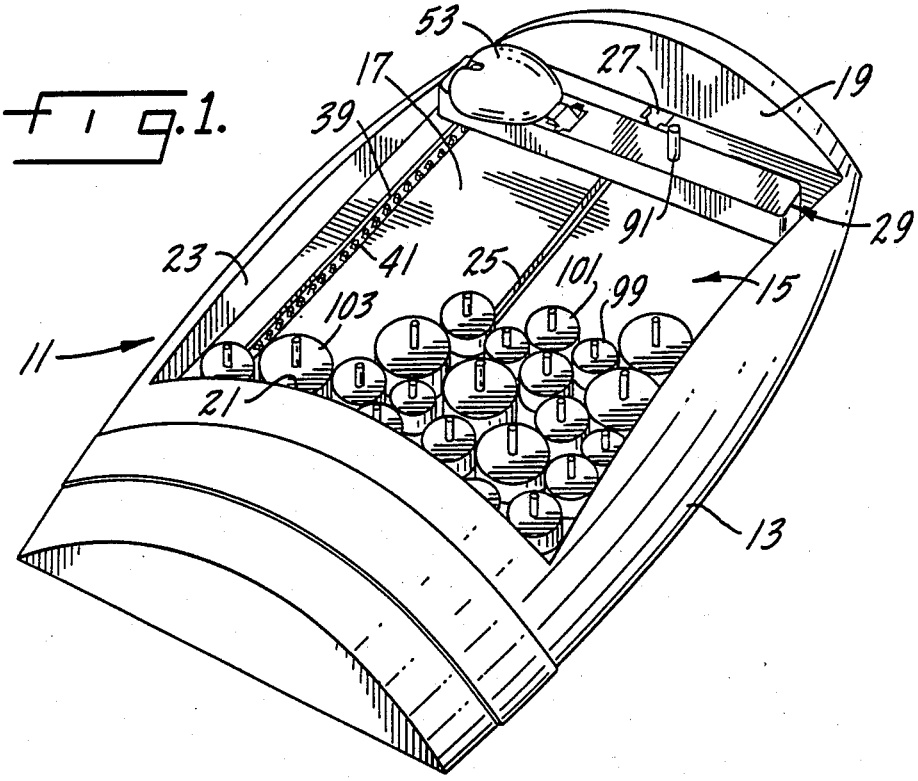
FIG. 1 is a perspective view of a tabletop game involving the novel aspects of this invention and showing the sliding bar in its locked position for loading of the playing pieces.

FIG. 1 of the drawings shows the tabletop game 11 embodying the novel aspects of this invention. The game 11 includes a molded plastic game board 13 in the shape of a portion of a barrel, with a well 15 formed in a side of the barrel to provide a bottom wall 17 defining a flat playing surface. The well is bounded on one end by a wall 19, on the other end by a wall 21 and has side walls 23 to enclose the flat playing surface 17.

Figure 2:
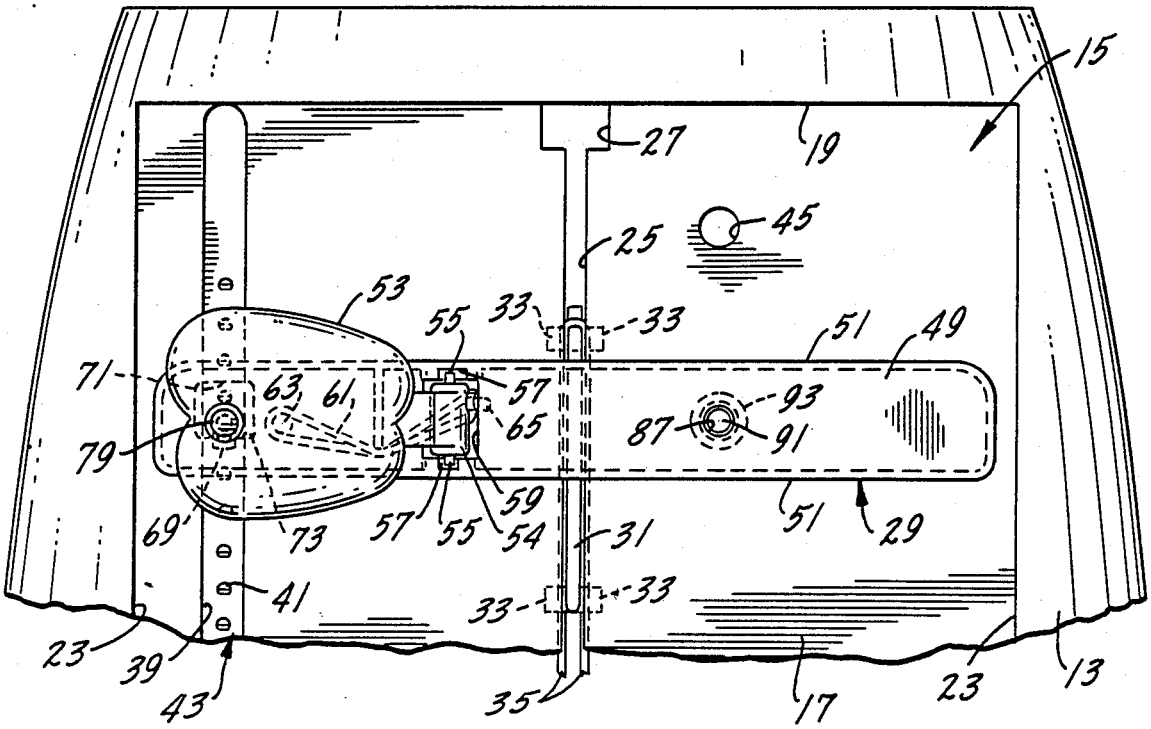
FIG. 2 is an enlarged, partial, top plan view of the game of this invention, with hidden parts shown in dashed lines.

A slot 25 through the bottom wall 17 of the game board extends the length of the well 15. It has an enlarged notch 27 at one end thereof, which is best shown in FIG. 2. The pressure-applying slide bar 29, which extends transversely of the game board, is positioned in the well. The slide bar has a guide keel 31 (FIG. 3) which fits into the slot 25. Laterally-extending ears 33 are formed on the keel at opposite ends thereof. The ears are wider than the slot 25 to prevent the keel from lifting out of the slot. A rubber band 35 (FIG. 2) connects one end of the slide bar keel with a tab (not shown) formed on the underside of the bottom wall 17 to bias the keel and slide bar 29 toward one end of the well. It should be noted that the enlarged notch 27 in the bottom wall 17 of the well is sufficiently large to permit the keel 31 and its ears 33 to be inserted through the notch to install the slide bar 29 in the well.

A trough 39 is formed in the bottom wall 17 of the game board 13 and extends the length of the well generally parallel to the slot 25. A series of evenly-spaced, upstanding teeth 41 are positioned in the trough to form a ratchet 43. Each ratchet tooth has a curved wall on one side and a generally flat inclined wall on the opposite side. A circular opening 45 is formed in the bottom wall 17 of the game board adjacent the enlarged notch 27.

Figure 3:
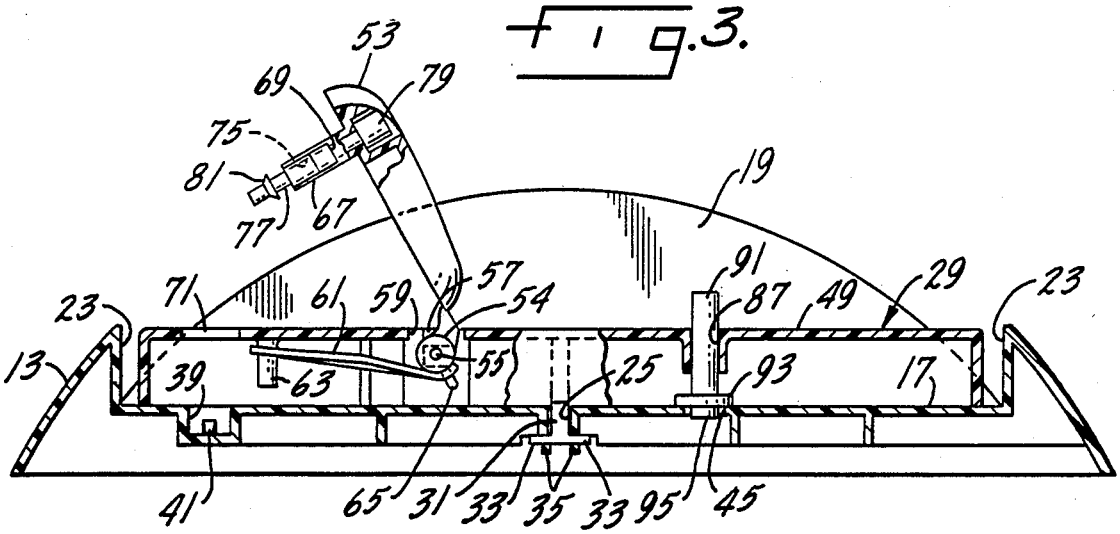
FIG. 3 is a transverse cross-sectional view of the game, with the sliding bar movement indicator shown in its raised or indicating position.
Figure 4:
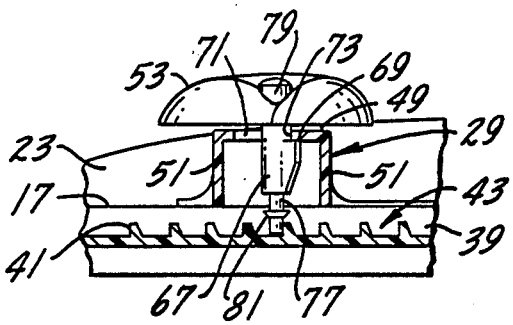
FIG. 4 is a partial, longitudinal cross-section showing the indicator in its lowered position, with the trip finger engaging a tooth of the ratchet.
Figure 5:
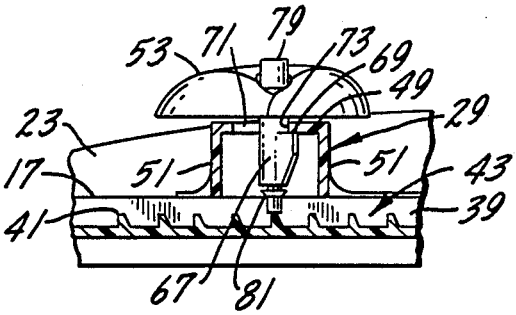
FIG. 5 is a view similar to FIG. 4, but showing the trip pin engaging the top of a ratchet tooth.

As can be best seen in FIGS. 3, 4 and 5 of the drawings, the slide bar 29 has a transverse cross-section of an inverted U-shape. The bar includes a top wall 49 and side walls 51. An indicator 53, which may be formed in the shape of a flattened, fanciful portion of an apple, has a shaft 54 with trunnions 55 at one end. The trunnions pivotally mount the indicator in oversized, rectangular openings 57 formed in the side walls 51 of the slide bar 29. The shaft 54 extends through an opening 59 formed in the top wall 49 of the slide bar. A rubber band 61 connects between a stud 63 formed on the bottom of the top wall 49 of the slide bar and a stud 65 formed on the indicator shaft 54 to bias the indicator to an upstanding position.

A tubular latch 67 extends downwardly from the end of the indicator opposite to the shaft 54 end and includes a ledge 69. When the indicator is in its lowered position, as shown, for example, in FIG. 4 of the drawings, the latch 67 will extend through an opening 71 in the top wall of the slide bar and the ledge 69 of the latch will engage the undersurface of an edge 73 of the top wall. A tubular passage 75 extends through the tubular latch from the top of the indicator to the bottom thereof. A trip finger 77 is slidably mounted in this passage. The trip finger has an enlarged cylinder head 79 at its upper end and a tapered head 81 at its bottom end thereof to retain the trip finger in the passage 75.

A circular passage 87 is formed in the top wall 49 of the slide bar and it receives a cylindrical plunger 91 having a collar 93 with a stub shaft 95. The stub shaft of the plunger fits into the circular opening 45 in the bottom wall 17 of the well 15 to hold the slide bar at the far end of the playing surface.

A quantity of three different sizes of playing pieces 99, 101 and 103 are provided for the game. In playing the game, the players move the slide bar 29 to the position shown in FIG. 1 so that the stub shaft 95 of the plunger 91 drops into the opening 45 in the bottom wall 17 to lock the slide bar in position. The locking of the slide bar at the far end of the playing surface permits the ready placement of the playing pieces 99, 101 and 103 on the bottom wall 17 of the well. These playing pieces are put in random order to provide a tight matrix. When they are all in place, the plunger 91 is lifted and the rubber band biases the slide bar into contact with the playing pieces to form a tight matrix. In previous games of this general type, the slide bar did not have means, such as the plunger 91, to permit it to be locked at the far end of the playing surface and it was difficult to place all of the playing pieces on the playing surface while holding the sliding bar clear of the playing pieces.

It is essential to proper play of the game that the slide bar 29 tightly compresses the playing pieces in a matrix so that it is difficult to remove a piece without causing the bar to move under the influence of its rubber band.

In previous games of this type, the indicator on the slide bar, which pops up to indicate movement, had a latch which held the indicator down against the biasing force of its rubber band and had a fixed rigid finger which rode along the ratchet teeth. However, in positions where the sliding bar was tightly wedged against the playing pieces and the rigid finger aligned with the top of a ratchet tooth, it was not possible to set the indicator in its latched position with the sliding bar held tightly against the playing pieces. When the finger was on the top of a ratchet tooth, it was necessary to move the slide bar away from the matrix of playing pieces until the finger was located behind a ratchet tooth. This rendered the slide bar less sensitive to the removal of a playing piece from the matrix of playing pieces.

The slide bar of this game can be held in tight engagement with the playing pieces along the entire length of the playing surface through the use of a trip finger that is movable vertically in the latch so that it can be positioned either directly behind a tooth, as shown in FIG. 4 of the drawings, or on top of a tooth, as shown in FIG. 5, to permit the slide bar to be positioned tightly against the matrix of playing pieces even when the trip finger 77 is located on top of a ratchet tooth 41.

As is conventional in games of this type, when the slide bar moves due to the removal of a playing piece from the playing surface, the ratchet tooth engages the trip finger and tilts the latch and thus the indicator, which is only loosely mounted by its trunnions to allow the indicator to slip and release the ledge 69 from under the edge 73 of the top wall of the sliding bar to allow the indicator to be moved to its upward position by the bias of the rubber band 69.

I claim:

1. In a game having a sliding bar biased for movement in one direction across a base and adapted to be held stationary only by engagement with an entrapped matrix of playing pieces located on the base, an indicator means carried on said sliding bar and formed and adapted to swing to an upright position when said sliding bar moves from a stationary position, a signal means including an indicator pivotally mounted on the sliding bar for movement between a generally horizontal and a generally upright position, means to bias said indicator to said upright position, latch means carried by said indicator and engageable with said sliding bar to hold said indicator in its horizontal position, a trip mechanism to release said latch means when said sliding bar moves in its biased direction, said trip mechanism including a finger formed on said indicator and engageable with any one of a series of teeth formed on said base to tilt the indicator and release the latch from the sliding bar when the bar moves in its biased direction, the improvement comprising:

a trip finger mounted for vertical movement between a tooth-engaging position and a tooth-clearing position to permit the indicator to be latched to the sliding bar in any position of the sliding bar relative to the teeth.

* * * * *